United States Patent [19]

Sheshtawy

[11] 3,937,278

[45] Feb. 10, 1976

[54] SELF-PROPELLING APPARATUS FOR WELL LOGGING TOOLS

[76] Inventor: Adel El Sheshtawy, 300 W. Grauwyler Road, Irving, Tex. 75061

[22] Filed: Sept. 12, 1974

[21] Appl. No.: 505,239

[52] U.S. Cl. ..... 166/63; 166/53

[51] Int. Cl.[2] ..... E21B 47/00

[58] Field of Search ..... 166/63, 299, 53, 250, 254; 175/6; 114/53

[56] References Cited

UNITED STATES PATENTS

| | | | |
|---|---|---|---|
| 1,630,003 | 5/1927 | Grebowiec | 114/53 |
| 3,121,465 | 2/1964 | Stephens | 166/63 |
| 3,255,822 | 6/1966 | Conrad | 166/63 |
| 3,465,356 | 9/1969 | Porter | 166/63 |

*Primary Examiner*—Stephen J. Novosad
*Attorney, Agent, or Firm*—Richards, Harris and Medlock

[57] ABSTRACT

A self-propelling apparatus for well logging tools includes a housing which is secured to the housing of a well logging tool and which defines a cylinder. A piston is slidably received in the cylinder, and a powder charge is mounted in the housing for electrical actuation. The cylinder is initially filled with a weighted fluid to establish a negative buoyancy whereby the well logging tool moves downwardly in a well to effect a logging operation. Upon completion of the well logging operation, a signal from the well logging tool actuates the powder charge whereby the piston forces the weighted fluid out of the cylinder and thereby establishes a positive buoyancy. This positive buoyancy together with the flow of the weighted fluid and the flow of gases resulting from the burning of the powder charge out of the housing combine to propel the well logging tool upwardly. At the top of the well the apparatus is siezed by latching apparatus and is retained thereby for subsequent retrieval.

20 Claims, 4 Drawing Figures

SELF-PROPELLING APPARATUS FOR WELL LOGGING TOOLS

BACKGROUND AND SUMMARY OF THE INVENTION

This invention relates to self-propelling apparatus for well logging tools, and more particularly to apparatus which functions automatically to first lower a logging tool into a well and thereafter to return the logging tool to the surface.

At the present time, most well logging operations are carried out by means of a wireline. This is considered to be unsatisfactory for a number of reasons. First, with the wireline in use, it is impossible to seal the well in case of a blowout, which is particularly important in off-shore operation. Second, both the wireline and the associated winching are additional apparatus to purchase and use.

Another method of conducting well logging operations is to simply drop the logging tool into the well and then remove it with the drill string. However, this method is so time consuming and costly that it is infeasable except in those instances in which the drill string will be removed irrespective of the logging operation.

Various attempts have heretofore been made at providing a self-propelled well logging tool. In accordance with one prior art system, a well logging tool is permitted to move downwardly at a controlled rate. At the completion of the logging operation, jet propulsion is employed to return the logging tool to the surface.

The foregoing type of self-propelling system for well logging tools is considered to be less than wholly satisfactory from a number of standpoints. First, the system requires a buoyancy section filled with cork or the like in order to partially counteract the weight of the apparatus. This is unsatisfactory because it limits the rate at which the logging tool can travel downwardly through the well. Second, due to its reliance on jet propulsion to return the logging tool to the surface, the prior art system tends to add a considerable amount of gas to well fluid, thereby substantially changing the density of the fluid. This is unsatisfactory because the fluid is typically controlled as to density so as to maintain a predetermined hydrostatic head. The presence of an undue amount of gas in the fluid would tend to lower the hydrostatic head which could in turn lead to a blowout of the well.

It will thus be seen that a need exists for still further improvements in the art of self-propelling apparatus for well logging tools. In particular, a need exists for a self-propelling system for well logging tools which permits the well logging tool to move downwardly in the well as rapidly as may be required for a particular logging operation. There also exists a need for a self-propelling apparatus for well logging tools which does not rely on jet propulsion as the sole means of returning the well logging tool to the surface.

The present invention relates to a self-propelling apparatus for well logging tools which overcomes the foregoing and other problems long since associated with the prior art. In accordance with the broader aspects of the invention, a housing is secured to the housing of a well logging tool, and defines a cylinder. The cylinder is initially filled with a weighted fluid to provide a negative buoyancy, whereby the well logging tool and the self-propelling apparatus attached thereto moved downwardly in the well at a rapid rate under the action of gravity. At the conclusion of the well logging operation, the weighted fluid is expelled from the cylinder to provide a positive buoyancy, whereby the well logging tool and the self-propelling apparatus are rapidly returned to the top of the well. At the top of the well the apparatus is seized by a latching apparatus and is retained for subsequent retrieval of the well logging tool.

In accordance with more specific aspects of the invention, a piston is slidably supported in the cylinder and is normally positioned at one end thereof. A powder charge is mounted in a portion of the housing adjacent to the initial positioning of the piston. The powder charge is adapted for electrical ignition.

At the conclusion of the well logging operation, and in response to the receipt of a signal from the well logging tool, the powder charge in the housing is ignited. This causes the piston to move to the opposite end of the cylinder, thereby expelling the weighted fluid and providing a positive buoyancy. The apparatus is designed such that both the weighted fluid and the expanding gases resulting from the burning of the powder charge flow out of the housing in such a way as to add a jet propulsion effect to the positive buoyancy. The combination of these two effects serve to rapidly return the well logging tool and the self-propelling apparatus to the surface.

In accordance with still other aspects of the invention, the housing is provided with check valves which function to maintain a pressure within the housing which is approximately 500 psi greater than that of the surrounding well fluid. This is advantageous in that since the pressure differential between the interior and the exterior of the housing is maintained at a minimum level, it is not necessary to fabricate the housing from high strength components. This in turn substantially reduces the cost of manufacturing and using the self-propelling apparatus.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
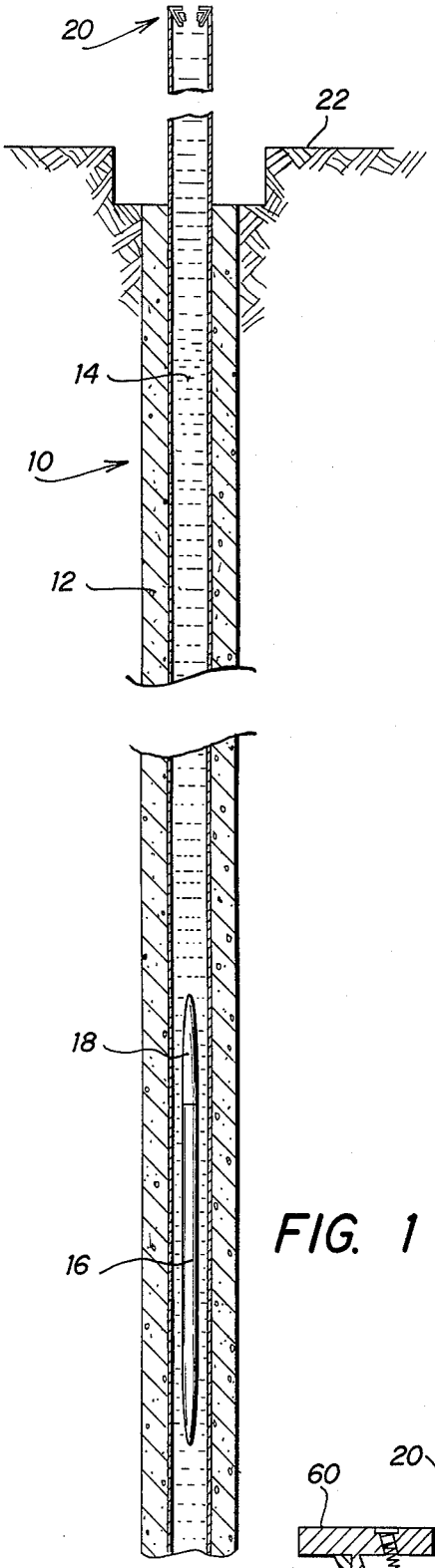
FIG. 1 is an illustration of the use of the invention.

Referring now to the Drawings, and particularly to FIG. 1 thereof, there is shown a well 10 having a casing 12 and filled with a well fluid 14. A logging tool 16 is shown traveling in the well 10 under the action of a self-propelling apparatus 18 incorporating the present invention. A latching apparatus 20 is mounted at the top of the well 10 and will ultimately serve to sieze the self-propelling apparatus 18 and the logging tool 16 secured thereto for subsequent retrieval from the surface 22.

The self-propelling apparatus 18 of the present invention may be used in conjunction with various commercially available well logging tools. Typical examples include the Totco Single or Double Shot Deviation Recorder sold by Technical Oil Tool Corp. of Glendale, Calif., the Model K4 Subsurface Recording Gauge sold by the Kuster Company of Long Beach, Calif.; various survey instruments sold by Eastman Whitstock, Inc. of Houston, Tex.; the Bottomhole Pressure Gauge sold by Flopetrol, a French concern or the like. Those skilled in the art will appreciate the fact that numerous additional logging tools are commercially available which are suitable for use in conjunction with the present invention, especially for off-shore operation and under water completion.

Figure 2:
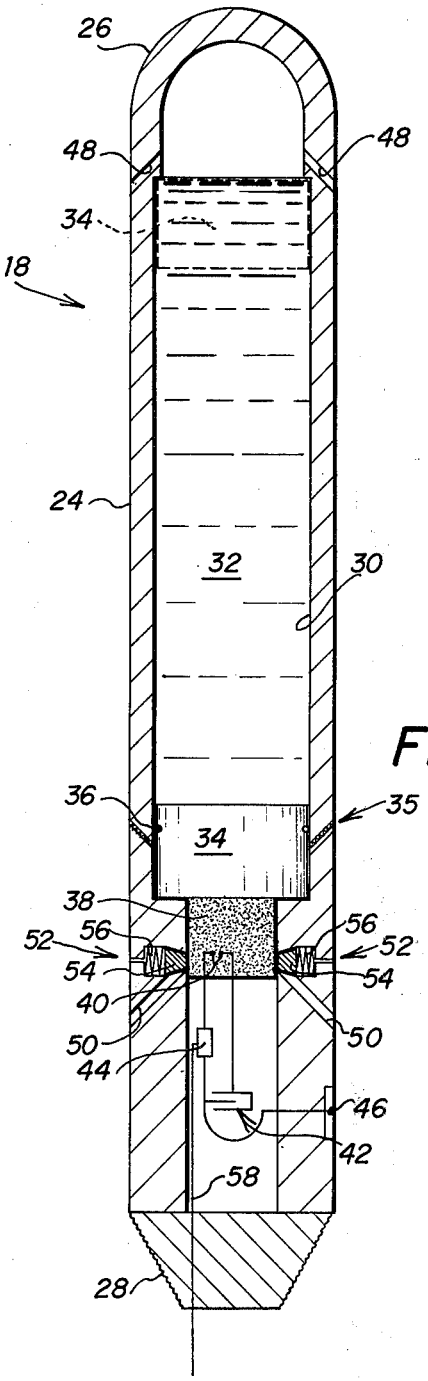
FIG. 2 is a sectional view of a self-propelling apparatus for well logging tools incorporating the invention.

The self-propelling apparatus 18 of the present invention is illustrated in greater detail in FIG. 2. The apparatus 18 includes a housing 24 formed from aluminum alloy or the like. The housing 24 is cylindrical in shape and has a rounded upper end 26 and a threaded lower end 28 which is adapted for connection to the housing of a logging tool. It will be understood that the housing 24 may be formed in various sections, if desired.

The housing 24 defines a cylinder 30 in the interior thereof. The cylinder 30 is initially filled with a weighted fluid 32, typically a high density liquid. By means of the weighted fluid 32, the self-propelling apparatus 18 and the well logging tool 16 connected thereto initially have a negative buoyancy. Due to this initial negative buoyancy, the well logging tool 16 and the self-propelling apparatus 18 move downwardly in the fluid 14 filling the casing 12 of the well 10 under the action of gravity. This downward movement may be as rapid as is necessary for a particular well logging operation.

A piston 34 is mounted in the cylinder 30 of the housing 24. The piston is mounted for reciprocation in the cylinder between the positions illustrated in full lines and in dashed lines in FIG. 2. The piston 34 is provided with a seal 36 which may comprise a conventional O-ring, and is initially positioned as shown in full lines.

A powder charge 38 is mounted in the housing 24 just below the cylinder 34. This is advantageous in that the seal 36 of the piston 34 also functions to seal the powder charge 38. A pair of arcing contacts 40 are mounted adjacent to the powder charge for use in effecting ignition thereof. The contacts 40 are adapted for actuation by voltage stored in a capacitor 42 under the control of an electronic switch 44. A contact 46 is provided for use in charging the capacitor 42.

The housing 24 is provided with a pair of vents 48 at the upper end thereof. The vents 48 are directed outwardly and downwardly. A second pair of vents 50 are also directed outwardly and downwardly. The vents 50 are connected to the interior of the housing through a pair of check valves 52 each including a piston 54 and a spring 56. The check valves 52 serve to maintain a pressure within the interior of the housing 24 which is approximately 500 psi greater than the pressure on the exterior of the housing 24.

In the use of the self-propelling apparatus 18, the cylinder 30 is initially filled with the weighted fluid 32. This may be done through the vents 48 and backing-off threads 35, or using any other convenient filling structure. The weighted fluid may comprise any fluid having sufficient density to provide an overall negative buoyancy for the self-propelling apparatus 18 and the well logging tool 16 that will be used in conjunction therewith.

After the cylinder 30 has been filled with the weighted fluid 32, the self-propelling apparatus 18 is connected to the well logging tool 16. The self-propelling apparatus 18 and the well logging tool 16 connected thereto are then positioned in the well 10 and are allowed to sink downwardly through the well fluid under the action of gravity. The downward movement of the well logging tool 16 and the self-propelling apparatus 18 connected thereto may be at any rate which may be necessary for the particular logging operation.

The electronic switch 44 of the self-propelling apparatus 18 has connected thereto a lead 58 which extends to control circuitry in the logging tool 16. Alternatively, timing circuitry may be provided within the housing 24 of the self-propelling apparatus 18. In any such event, upon completion of the logging operation the switch 44 is actuated to discharge the capacitor 42 through the contacts 40. This ignites the powder charge 38, whereby the interior of the lower portion of the housing 24 is rapidly filled with the expanding gaseous products of combustion of the burning powder charge 38. This action rapidly pushes the piston 34 upwardly until it is in the position illustrated in dashed lines in FIG. 2.

When the piston 34 is in the upper position, the cylinder 30 is filled with gas rather than with the weighted fluid 32. This establishes a positive buoyancy for the self-propelling apparatus 18 and the well logging tool 16 connected thereto. In and of itself this positive buoyancy is sufficient to raise the self-propelling apparatus 18 and the well logging tool 16 to the surface.

As the piston 34 is pushed upwardly to the uppermost position, the weighted fluid 32 is expelled from the cylinder 30 through the vents 48. Since the vents 48 are directed outwardly and downwardly, the weighted fluid 32 flowing out of the cylinder 30 through the vents 48 provides a jet propulsion action which aids the positive buoyancy in raising the self-propelling apparatus 18 and the well logging tool 16 connected thereto to the surface. Simultaneously, the products of combustion of the burning powder charge 38 are discharged from the housing 24 through the vents 50 under the control of the check valves 52. Since the vents 50 are also directed outwardly and downwardly, the flow of the products of combustion out of the housing 24 through the vents 50 also provides a jet propulsion effect which aids the positive buoyancy in raising the self-propelling apparatus 18 and the well logging tool 16 connected thereto to the surface.

Those skilled in the art will appreciate the fact that the self-propelling apparatus 18 is not limited to the arcing contact/powder charge structure illustrated in FIG. 2. Rather than storing voltage in the capacitor 42, the apparatus 18 could be provided with a battery and a blasting cap adapted for actuation by the battery under the control of the electronic switch 44. In certain applications the blasting cap in and of itself would be sufficient to provide the force necessary to move the piston from the lower position illustrated in full lines to the upper position illustrated in dashed lines in FIG. 2. Other alternative structures for moving the piston from one end of the cylinder 30 to the other will readily suggest themselves to those skilled in the art.

Figure 3:
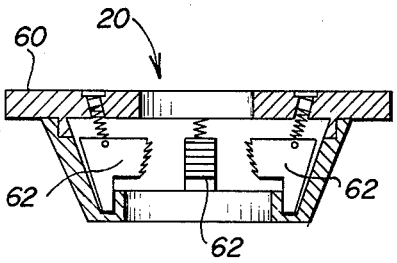
FIG. 3 is a sectional view of a latching apparatus useful in conjunction with the invention.
Figure 4:
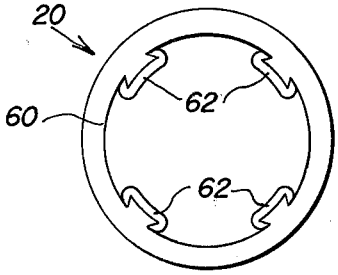
FIG. 4 is a top view of the latching apparatus of FIG. 3.

When the self-propelling apparatus 18 and the logging tool 16 connected thereto arrive at the top of the well 10, the self-propelling apparatus 18 is seized by the latching apparatus 20. As is best shown in FIGS. 3 and 4, the latching apparatus 20 includes a circular frame 60 having a plurality of jaws 62 pivotally supported therein and spring biased inwardly. As the self-propelling apparatus 18 and the logging tool 16 connected thereto arrive at the surface, the self-propelling apparatus 18 is siezed by the spring biased jaws 62 and is retained thereby for subsequent retrieval from the surface 22. It will be noted that due to the nature of the jaws 62, it is possible to simply pull the self-propelling apparatus 18 and the logging tool 16 upwardly through the latching apparatus 20.

It will be appreciated that various other types of latching apparatus may be utilized in conjunction with the present invention. However, the latching apparatus 20 illustrated in FIGS. 3 and 4 incorporated certain advantages. For example, the frame 60 of the latching apparatus 20 is dimensioned to fit in the clearance which is normally provided in the tool joint of the drill string. This is advantageous in that no additional structure is required in order to properly position the latching apparatus 20.

It will thus be understood that the present invention comprises a self-propelling apparatus for well logging tools which incorporates numerous advantages over the prior art. One of the more important advantages deriving from the use of the invention involves the fact that by means thereof, a well logging tool may be automatically lowered to the bottom of a well at whatever rate is necessary in accordance with particular logging operations. Another advantage involves the fact that the device functions automatically to return the well logging tool to the surface and yet discharges a minimum of gas into the well fluid. This is advantageous because it results in minimum disturbance of the density of the well fluid. Still another advantage to the use of the invention involves the fact that by means of the check valves, the pressure differential between the interior of the housing and the exterior thereof is maintained at a minimum level. This is advantageous because it eliminates the necessity of fabricating the housing from high strength components. This fact together with the fact that the self-propelling apparatus of the present invention is adapted for repeated usage provides an extremely economical system for lowering a well logging tool into a well and for subsequently returning the logging tool to the surface.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A self-propelling apparatus for well logging tools for use within a well bore having a well fluid therein comprising:

a housing defining a cylinder therein and including means for attachment to an end of an elongated well logging tool;

vent means communicating between the cylinder in the housing and the exterior thereof wherein said vent means are outwardly directed;

a piston initially received in one end of the cylinder;

said cylinder for initially receiving a quantity of liquid to establish an overall negative buoyancy in the well fluid for the self-propelling apparatus and the well logging tool connected thereto; and means responsive to a predetermined signal for driving the piston from its initial position to the opposite end of the cylinder to expel the liquid from the cylinder through said vent means and thereby establish an overall positive buoyancy for the self-propelling apparatus and the well logging tool connected thereto.

2. The self-propelling apparatus according to claim 1 wherein the outwardly directed vent means extend to downwardly directed outlet means whereby the action of the piston in expelling the liquid from the cylinder cooperates with the positive buoyancy resulting therefrom to propel the self-propelling apparatus upwards and the well logging tool connected thereto.

3. The self-propelling apparatus according to claim 1 wherein the means for driving the piston from its initial position to the opposite end of the cylinder comprises an explosive composition contained within the housing and means responsive to the predetermined signal for igniting the explosive composition.

4. The self-propelling apparatus according to claim 3 further including vent means for exhausting expanding products of combustion from the housing, said vent means extending to downwardly directed outlet means whereby the products of combustion cooperate with the positive buoyancy to propel the self-propelling apparatus upward and the well logging tool connected thereto.

5. The self-propelling apparatus according to claim 3 wherein said means for igniting the explosive composition is further characterized by means for receiving a signal from the well logging tool connected to the housing.

6. The self-propelling apparatus according to claim 1 and further including check valve means for maintaining a predetermined pressure differential between the interior of the housing and the exterior thereof when the liquid is initially expelled from the cylinder, thereby reducing the pressure within the interior of the housing while the self-propelling apparatus is ascending within the well to regions of lower well pressure.

7. The self-propelling apparatus according to claim 5 wherein said check valve means has a spring of predetermined stiffness to open said check valve means to maintain a predetermined pressure differential between the interior of the housing and the exterior thereof.

8. A self-propelling apparatus for well logging tools comprising:

a housing including means for attachment to a well logging tool;

the interior of the housing defining an elongate cylinder for initially receiving a quantity of liquid and thereby establishing an overall negative buoyancy for the self-propelling apparatus and the well logging tool attached thereto;

a piston initially positioned at one end of the cylinder;

vent means communicating between the opposite end of the cylinder and the exterior of the housing wherein said vent means are outwardly directed;

an explosive composition mounted within the housing;

means responsive to a predetermined signal for igniting the explosive composition and thereby driving the piston from its initial position to the opposite end of the housing to expel the liquid from the cylinder through said vent means and thus establish an overall positive buoyancy for the self-propelling apparatus and the well logging tool connected thereto; and said means for igniting the explosive composition is further characterized by means for receiving a signal from the well logging tool connected to the housing.

9. The self-propelling apparatus according to claim 8 wherein the outwardly directed vent means from the cylinder extend to downwardly directed outlet means so that the liquid from the cylinder operates in cooperation with the positive buoyancy to propel the self-propelling apparatus and the well logging tool attached thereto upwards as the liquid is expelled from the cylinder.

10. The self-propelling apparatus according to claim 9 further including vent means for exhausting products of combustion from the interior of the housing, said vent means extending to downwardly directed outlet means whereby the products of combustion cooperate with the positive buoyancy to propel the self-propelling apparatus and the well logging tool connected thereto as they are exhausted from the housing.

11. The self-propelling apparatus according to claim 10 wherein the vent means for products of combustion include check valve means for maintaining a predetermined pressure differential between the interior of the housing and the exterior thereof upon the expulsion of liquid from the cylinder.

12. The self-propelling apparatus according to claim 8 wherein the piston means includes sealing means and wherein the explosive composition is positioned on the opposite side of the piston from the cylinder so that the sealing means of the piston also functions to seal the explosive composition.

13. A self-propelling apparatus for well logging tools comprising:

an elongate, cylindrical housing having means at one end thereof for attachment to a well logging tool;

said housing defining in the interior thereof an elongate cylinder for initially receiving a quantity of liquid to provide an initial overall negative buoyancy for the self-propelling apparatus and the well logging tool;

piston means initially positioned at one end of the cylinder in the housing;

said piston means including sealing means engaging the walls of the cylinder to effect a seal therewith;

vent means communicating with the opposite end of the cylinder and extending outwardly to the exterior of the housing;

said housing further including a chamber communicating with the cylinder and extending from said one end thereof;

a quantity of material mounted in the chamber of the housing and adapted for ignition to provide a substantial quantity of highly pressurized products of combustion;

means for igniting said material in response to a predetermined signal and thereby driving the piston from said one end of the cylinder to the opposite end thereof to expel the liquid from the cylinder through said vent means and thereby provide an overall positive buoyancy for the self-propelling apparatus and the well logging tool; and electrical ignition means for initiating combustion of the material in the chamber of the housing;

actuation means for activating the electrical ignition means;

switch means for normally preventing operation of the electrical ignition means under the action of the actuation means; and input means for causing the switch means to electrically interconnect the actuation means and the ignition means and thereby effect ignition of the material.

14. The self-propelling apparatus according to claim 13 further characterized by relief valve means for maintaining a predetermined pressure differential between the interior of the housing and the exterior thereof upon the expulsion of the liquid from the cylinder by the highly pressurized products of combustion.

15. The self-propelling apparatus according to claim 13 wherein the relief valve means extend to vent means for exhausting the products of combustion from the interior of the housing, said products of combustion vent means extending to downwardly directed outlet means whereby the exhausting products of combustion cooperate with the positive buoyancy to propel the self-propelling apparatus and the well logging tool attached thereto.

16. The self-propelling apparatus according to claim 13 wherein the vent means communicating with the cylinder extend to downwardly directed outlet means whereby the flow of the liquid out of the cylinder under the action of the piston means assists the positive buoyancy created thereby in propelling the self-propelling apparatus and the well logging tool connected thereto.

17. In combination:

a well comprising a tubular string having a well fluid therein;

a well logging tool for movement through the well fluid in the well to carry out a well logging operation;

said well logging tool having a housing;

a self-propelling apparatus for controlling the movement of the well logging tool through the well fluid in the well;

said self-propelling apparatus having a housing including means for connection to the housing of the well logging tool;

the housing of the self-propelling apparatus defining a cylinder for initially receiving a quantity of liquid and thereby causing the self-propelling apparatus/well logging tool assembly to have a negative buoyancy relative to the well fluid in the well;

means in the self-propelling apparatus responsive to a predetermined signal for expelling the liquid from the cylinder of the self-propelling apparatus and thereby causing the self-propelling apparatus/well logging tool assembly to have a positive buoyancy relative to the well fluid in the well; and latching apparatus mounted at the top of the tubular string of the well for receiving and retaining the buoyant self-propelling apparatus/well logging tool assembly, wherein said latching apparatus comprises a plurality of spring loaded jaws positioned at spaced points around the periphery of the tubular string of the well.

18. The combination according to claim 17 wherein the liquid expelling apparatus comprises a piston mounted for reciprocation in the cylinder of the housing of the self-propelling apparatus and initially positioned at one end thereof, vent means communicating between the opposite end of the cylinder and the exterior of the housing of the self-propelling apparatus, and means responsive to the predetermined signal for driving the piston from its initial position to the opposite end of the cylinder and thereby expelling the liquid from the cylinder through the vent means.

19. The combination according to claim 17 wherein the piston driving means comprises a quantity of material initially received in the housing for combustion to form a substantial quantity of high pressure products of combustion which drive the piston from its initial position to the opposite end of the cylinder, and means responsive to the predetermined signal for igniting the material.

20. The combination according to claim 19 wherein both the liquid and the products of combustion are discharged from the housing of the self-propelling apparatus in such a direction as to assist the positive buoyancy in propelling the self-propelling apparatus/-well logging tool assembly, and further including check valve means for maintaining a predetermined pressure differential between the interior and the exterior of the housing of the self-propelling apparatus.

* * * * *